United States Patent [19]

Podraza

[11] Patent Number: 4,690,157

[45] Date of Patent: Sep. 1, 1987

[54] SMOKING COMPOSITIONS CONTAINING A FLAVORANT-RELEASE ADDITIVE

[75] Inventor: Kenneth F. Podraza, Richmond, Va.

[73] Assignee: Philip Morris Incorporated, New York, N.Y.

[21] Appl. No.: 842,695

[22] Filed: Mar. 21, 1986

[51] Int. Cl.[4] ..... A24B 3/12; A24B 15/40

[52] U.S. Cl. ..... 131/276; 131/277

[58] Field of Search ..... 131/276, 277, 278, 279

*Primary Examiner*—V. Millen

[57] ABSTRACT

This invention provides smoking compositions which contain a novel hydroxylactone flavorant-release additive.

Under cigarette smoking conditions, an additive such as 2-(1-hydroxy-1-phenylmethyl)-γ-butyrolactone pyrolyzes into volatile benzaldehyde and γ-butyrolactone constituents which enhance the flavor and aroma of the cigarette smoke.

12 Claims, No Drawings

SMOKING COMPOSITIONS CONTAINING A FLAVORANT-RELEASE ADDITIVE

BACKGROUND OF THE INVENTION

A variety of flavorants have been developed and proposed for incorporation into tobacco products. Illustrative of such tobacco flavorants are those described in U.S. Pat. Nos. 3,580,259; 3,625,224; 3,722,516; 3,750,674; 3,879,425; 3,881,025; 3,884,247; 3,890,981; 3,903,900; 3,914,451; 3,915,175; 3,920,027; 3,924,644; 3,937,228; 3,943,943; 3,586,387: 4,379,754; and the like.

J. C. Leffingwell et al "Tobacco Flavoring For Smoking Products" (R. J. Reynolds publication, 1972) includes a listing of desirable flavorants for smoking compositions.

Of specific interest with respect to the present invention is the proposed utilization of lactone compounds as flavorants in tobacco products. Various lactones are known to contribute desirable properties to the flavor and aroma of tobacco products under smoking conditions.

U.S. Pat. No. 3,251,366 describes tobacco products that contain a lactone flavorant additive such as $\alpha,\beta$-dimethyl-$\gamma$-pentyl-$\gamma$-hydroxybutenolide which imparts a celery-like note to mainstream smoke.

U.S. Pat. No. 3,372,699 and U.S. Pat. No. 3,372,700 describe the use of a lactone such as $\beta$-methylbutyrolactone or 4-hydroxy-4-methyl-5-hexenoic acid $\gamma$ lactone as a flavorant additive in tobacco products.

U.S. Pat. No. 3,380,457; U.S. Pat. No. 3,563,248; and U.S. Pat. No. 3,861,403 describe other lactones which are recommended for use as flavorant additives in tobacco products, such as $\beta$-methyl-$\delta$-valerolactone, 3-(2-hydroxycyclohexyl)propionic acid $\delta$ lactone, 4-methyl-6-n-pentyl-$\alpha$-pyrone, and the like.

The high degree of volatility and ease of sublimation of flavorant additives such as aldehydes, ethers and lactones in tobacco products have presented problems in the manufacturing operations, and have resulted in a decreased shelf-life of the products due to losses of flavorant by evaporation on storage.

Recent developments have involved incorporating a low volatility organic additive to a 15 smoking composition, which under smoking conditions is pyrolyzed into one or more fragments that function to improve the taste and character of mainstream tobacco smoke, and in some cases a consequential improvement of sidestream smoke aroma.

U.S. Pat. No. 4,036,237 describes smoking compositions which contain an aromatic beta-hydroxy ester flavorant such as ethyl 2,2-dimethyl-3-hydroxy-3phenylpropionate, which pyrolyzes under smoking conditions to release benzaldehyde and ethyl isobutyrate flavorants.

U.S. Pat. No. 4,312,368 describes smoking compositions which contain a heterocyclic-hydroxy-substituted carboxylate flavorant-release additive such as ethyl 2-(2-butyl)-3-hydroxy-3-methyl-3-(3-pyridyl)propionate. Under smoking conditions this additive pyrolyzes into 3-acetylpyridine and ethyl $\beta$-methylvalerate flavorants.

There is continuing research effort to develop improved smoking compositions which generate mainstream smoke with flavorant-enhanced taste and character under smoking conditions.

Accordingly, it is an object of this invention to provide smoking compositions having incorporated therein a flavorant component which is characterized by lack of mobility and/or volatility at ambient temperature.

It is another object of this invention to provide smoking compositions having incorporated therein a flavorant-release additive which under normal smoking conditions imparts improved flavor to mainstream smoke and improved aroma to sidestream smoke.

It is a further object of this invention to provide novel organic compounds which are adapted to be incorporated into cigarette fillers, and which under normal smoking conditions release volatile lactone and other flavorant constituents into cigarette smoke.

Other objects and advantages of the present invention shall become apparent from the following description and examples.

DESCRIPTION OF THE INVENTION

One or more objects of the present invention are accomplished by the provision of a smoking composition comprising an admixture of (1) combustible filler selected from natural tobacco, reconstituted tobacco and tobacco substitutes, and (2) between about 0.0001–5 weight percent, based on the total weight of filler, of a flavorant-release additive corresponding to the formula:

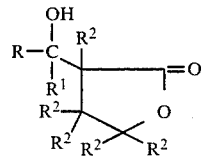

where R is an aromatic substituent containing between about 4–10 carbon atoms; and $R^1$ and $R^2$ are substituents selected from hydrogen and aliphatic, aromatic and alicyclic radicals containing between about 1–10 carbon atoms.

In another embodiment, this invention provides a smoking composition comprising an admixture of (1) combustible filler selected from natural tobacco, reconstituted tobacco and tobacco substitutes, and (2) between about 0.0001–5 weight percent, based on the total weight of filler, of a flavorant-release additive corresponding to the formula:

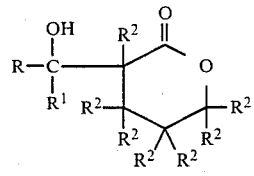

where R is an aromatic substituent containing between about 4–10 carbon atoms; and $R^1$ and $R^2$ are substituents selected from hydrogen and aliphatic, aromatic and alicyclic radicals containing between about 1–10 carbon atoms.

In the formulae represented above, the R substituent is illustrated by radicals which include phenyl, tolyl, ethylphenyl, methoxyphenyl, hydroxyphenyl, naphthyl, pyridyl, pyrazyl, and the like.

Illustrative of $R^1$ and $R^2$ are radicals which include methyl, propyl, butyl, butenyl, pentyl, octenyl, methoxyethyl, cyclopropyl, cyclopentyl, cyclohexyl, methoxycyclohexyl, menthyl, phenyl, tolyl, xylyl, benzyl, phenylethyl, methoxyphenyl, naphthyl, furyl, tetrahydrofuryl, piperidyl, pyrrolidyl, pyridyl, pyridazyl, pyrazyl, and the like.

Preferred hydroxylactone compounds adapted for application as flavorant-release additives in smoking compositions are compounds corresponding to the formulae:

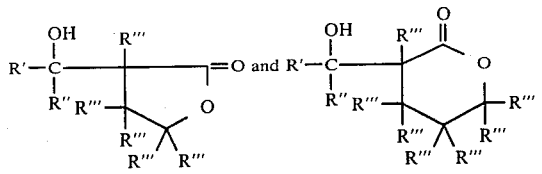

where R′ is a phenyl or substituted phenyl radical; R″ is hydrogen or an alkyl radical containing between about 1–4 carbon atoms; and R‴ is a substituent selected from hydrogen and aliphatic, aromatic and alicyclic radicals containing between about 1–10 carbon atoms. Preferably, R‴ is hydrogen or an alkyl radical containing between about 1–4 carbon atoms.

Illustrative of substituted phenyl radicals are tolyl, xylyl, mesitylyl, methoxyphenyl, ethoxyphenyl, hydroxyphenyl, acetylphenyl, carbethoxyphenyl, and the like.

A hydroxylactone compound which is incorporated in smoking compositions as described above is a low volatility additive which under normal smoking conditions pyrolyzes into volatile constituents which enhance the flavor and aroma of low delivery cigarette smoke:

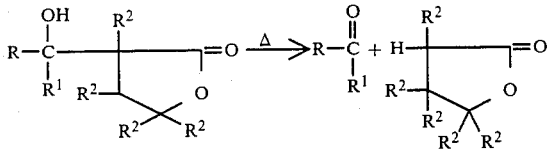

The present invention hydroxylactone flavorant additives are stable and odorless compounds at ambient temperature. In addition, the hydroxylactone compounds decompose at a relatively low pyrolysis temperature (e.g., 150°–300° C.) to release a high yield of desirable flavor-enhancing components in mainstream smoke.

Hydroxylactone compounds of interest are described in publications such as Tetrahedron Letters, No. 26, 2253, 1976; and Bull. Chem. Soc. Japan, 52(8), 2389(1979); incorporated by reference.

Preparation of Hydroxylactones

A general procedure for preparation of the present invention hydroxylactone flavorant-release compounds involves the reaction of a lactone derivative with a strong base to form an organometallic carbanion at the 2-position of the lactone, and the subsequent nucleophilic condensation of the lactone with a carbonyl compound:

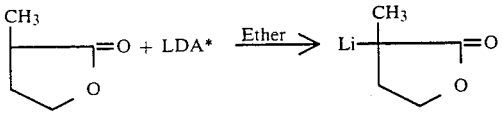

(1)

-continued

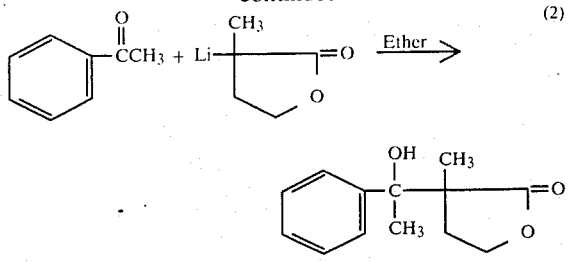

(2)

*Lithium diisopropylamide

Preparation Of Tobacco Compositions

In a further embodiment, the present invention provides a method of preparing a smoking composition which is adapted to impart flavor and aroma to mainstream and sidestream smoke under smoking conditions, which method comprises incorporating into natural tobacco, reconstituted tobacco or tobacco substitute between about 0.0001–5 weight percent, based on composition weight, of a flavorant-release additive corresponding to the formula:

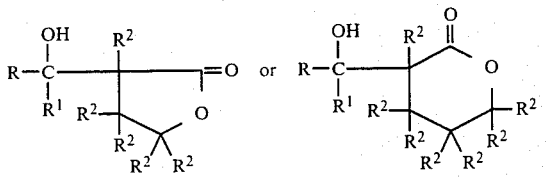

where R is an aromatic substituent containing between about 4–10 carbon atoms; and $R^1$ and $R^2$ are substituents selected from hydrogen and aliphatic, aromatic and alicyclic radicals containing between about 1–10 carbon atoms.

The invention flavorant-release additive can be incorporated into the tobacco or tobacco substitute in accordance with methods known and used in the art. Preferably the flavorant-release additive is dissolved in a solvent such as alcohol or aqueous alcohol and then sprayed or injected into the tobacco and/or tobacco substitute matrix. Such method ensures an even distribution of the flavorant additive throughout the filler, and thereby facilitates the production of a more uniform smoking composition. Alternatively, the flavorant may be incorporated as part of a concentrated tobacco extract which is applied to a fibrous tobacco web as in the manufacture of reconstituted tobacco. Another suitable procedure is to incorporate the flavorant in tobacco or tobacco substitute filler in a concentration between about 0.5–5 weight percent, based on the weight of filler, and then subsequently to blend the treated filler with filler which does not contain flavorant additive.

The term "tobacco substitute" is meant to include non-tobacco smoking filler materials such as are disclosed in U.S. Pat. Nos. 3,703,177; 3,796,222; 4,019,521; 4,079,742; and references cited therein, incorporated herein by reference.

U.S. Pat. No. 3,703,177 describes a process for preparing a non-tobacco smoking product from sugar beet pulp, which process involves the acid hydrolysis of the beet pulp to release beet pectins, and at least an alkaline earth treatment thereafter to cause crosslinking of the pectins and the formation of a binding agent for the exhausted beet matrix.

U.S. Pat. No. 3,796,222 describes a smoking product derived from coffee bean hulls. The hulls are treated with reagents that attack the alkaline earth metal cross-links causing the release of the coffee pectins. The pectins act as a binding agent and together with the treated hulls may be handled and used similarly to a tobacco product.

U.S. Pat. No. 4,019,521 discloses a process for forming a smoking material which involves heating a cellulosic or carbohydrate material at a temperature of 150°–750° C. in an inert atmosphere for a period of time sufficient to effect a weight loss of at least 60 percent but not more than 90 percent.

U.S. Pat. No. 4,079,742 discloses a process for the manufacture of a synthetic smoking product from a cellulosic material, which process involves a pyrolysis step and a basic extraction step to yield a resultant matrix which has a tobacco-like brown color and has improved smoking characteristics.

The following Examples are further illustrative of the present invention. The specific ingredients and processing parameters are presented as being typical, and various modifications can be derived in view of the foregoing disclosure within the scope of the invention.

EXAMPLE I

This Example illustrates the preparation of hydroxy-γ-butyrolactone compounds in accordance with the present invention.

A.

To a solution of 2.22 g (22 mmoles) of diisopropylamine in 50 ml of ether, under nitrogen and at 0° C., is added 13.75 ml (22 mmoles) of 1.6 M n-butyllithium in hexane. The solution is stirred at 0° C. for 15 minutes. To the solution of lithium diisopropylamide is added 2.0 g (20 mmoles) of 2-methyl-γ-butyrolactone in 10 ml of ether.

The mixture is stirred for 20 minutes. Benzaldehyde (2.12 g, 20 mmoles) is added and the mixture is stirred for 1 hour at 0° C., then for an additional 2 hours at room temperature. Water is added, and the formed layers are separated.

The ether layer is washed with water and dried over anhydrous magnesium sulfate. Evaporation of the solvent under reduced pressure yields a solid which is recrystallized with ethyl acetate and hexane to yield 1.5 g of 2-(1-hydroxy-1-phenylmethyl)-2-methyl-γ-butyrolactone.

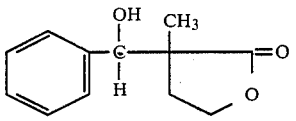

NMR and IR data confirm the above structure. Analysis calc. for $C_{12}H_{14}O_3$: C,69.89; H,6.84 Found: C,69.65; H,7.02.

B.

Using the same procedure as described above, acetophenone is reacted with γ-butyrolactone to produce 2-(1-hydroxy-1-methyl-1-phenylmethyl)-γ-butyrolactone.

Benzaldehyde is reacted with γ-butyrolactone to produce 2-(1-hydroxy-1-phenylmethyl)-γ-butyrolactone.

EXAMPLE II

This Example illustrates the preparation of hydroxy-δ-valerolactones in accordance with the present invention.

Employing a procedure which is similar to that described in Example I, benzaldehyde is reacted with δ-valerolactone to produce 2-(1-hydroxy-1-phenylmethyl)-δ-valerolactone.

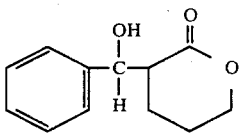

Acetophenone is reacted with 6-valerolactone to produce 2-(1-hydroxy-1-methyl-1-phenylmethyl)-δ-valerolactone.

Benzaldehyde is reacted with 2-methyl-δ-valerolactone to produce 2-(1-hydroxy-1-phenylmethyl)-2-methyl-δ-valerolactone.

EXAMPLE III

This Example illustrates the pyrolysis of hydroxylactones into volatile lactone and carbonyl constituents.

A 10–50 mg sample of 2-(1-hydroxy-1-phenylmethyl)-2-methyl-γ-butyrolactone is pyrolyzed in a tube at 250° C. for 5 minutes. The yield of benzaldehyde and 2-methyl-γ-butyrolactone released is quantitative as indicated by TLC and GC analyses.

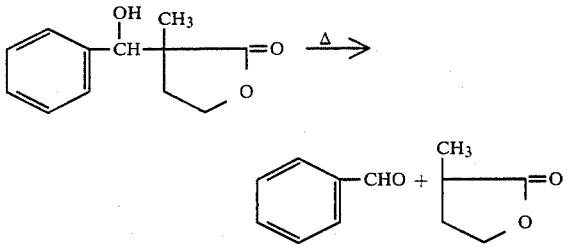

Under similar pyrolysis conditions, other hydroxylactones yield the pyrolysis products listed in Table I.

TABLE I

| Hydroxylactone | Pyrolysis Products carbonyl | lactone |
|---|---|---|
| 2-(1-hydroxy-1-phenylmethyl)-γ-butyrolactone | benzaldehyde | γ-butyrolactone |
| 2-(1-hydroxy-1-methyl-1-phenylmethyl)-γ-butyrolactone | acetophenone | γ-butyrolactone |
| 2-(1-hydroxyl-1-phenylmethyl)-δ-valerolactone | benzaldehyde | δ-valerolactone |
| 2-(1-hydroxy-1-methyl-1-phenylmethyl)-δ-valerolactone | acetophenone | δ-valerolactone |
| 2-(1-hydroxy-1-phenylmethyl)-2-methyl-δ-valerolactone | benzaldehyde | 2-methyl-δ-valerolactone |
| 2-(1-hydroxy-1-phenylmethyl)-γ-valerolactone | benzaldehyde | γ-valerolactone |
| 2-(1-hydroxy-1-methyl-1-phenylmethyl)-γ-valerolactone | acetophenone | γ-valerolactone |

TABLE I-continued

| Hydroxylactone | Pyrolysis Products carbonyl | lactone |
|---|---|---|
| 2-(1-hydroxy-1-phenylmethyl)-γ-decalactone | benzaldehyde | γ-decalactone |
| 2-(1-hydroxy-1-methyl-1-phenylmethyl)-γ-octalactone | acetophenone | γ-octalactone |
| 2-(1-hydroxy-1-phenylmethyl)-4-phenyl-γ-butyrolactone | benzaldehyde | 4-phenyl-γ-butyrolactone |
| 2-(1-hydroxy-1-methyl-1-phenylmethyl)-4-phenyl-γ-butyrolactone | acetophenone | 4-phenyl-γ-butyrolactone |
| 2-(1-hydroxy-1-phenylmethyl)-5-phenyl-δ-valerolactone | benzaldehyde | 5-phenyl-δ-valerolactone |
| 2-(1-hydroxy-1-methyl-1-phenylmethyl)-5-phenyl-δ-valerolactone | acetophenone | 5-phenyl-δ-valerolactone |

EXAMPLE IV

This Example illustrates the preparation of smoking compositions in accordance with the present invention.

Cigarettes are fabricated employing a blend of tobaccos treated with an ethanolic solution of the Example I 2-(1-hydroxy-1-phenylmethyl)-2-methyl-γ-butyrolactone to provide 0.0001% of the compound by weight of the tobacco. The cigarettes are targeted to deliver 8 mg of tar per cigarette.

Untreated controls are prepared and the treated cigarettes are compared to the controls by an experienced smoking panel. The treated cigarettes are found to have a distinct bitter-nutty pecan-like flavor as compared to the controls.

Similar pyrolytic release of flavorant can be achieved with the other hydroxylactone compounds described in Examples I–II.

What is claimed is:

1. A smoking composition comprising an admixture of (1) combustible filler selected from natural tobacco, reconstituted tobacco and tobacco substitutes, and (2) between about 0.0001–5 weight percent, based on the total weight of filler, of a flavorant-release additive corresponding to the formula:

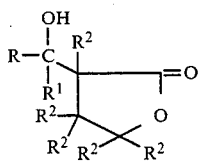

where R is an aromatic substituent containing between about 4–10 carbon atoms; and $R^1$ and $R^2$ are substituents selected from hydrogen and aliphatic, aromatic and alicyclic radicals containing between about 1–10 carbon atoms.

2. A smoking composition in accordance with claim 1 wherein in the flavorant-release additive formula R is a phenyl or substituted phenyl radical, and $R^1$ and $R^2$ are hydrogen or an alkyl radical containing between about 1–4 carbon atoms.

3. A smoking composition in accordance with claim 1 wherein the flavorant-release additive is 2-(1-hydroxy-1-phenylmethyl)-γ-butyrolactone.

4. A smoking composition in accordance with claim 1 wherein the flavorant-release additive is 2-(1-hydroxy-1-methyl-1-phenylmethyl)-γ-butyrolactone.

5. A smoking composition in accordance with claim 1 wherein the flavorant-release additive is 2-(1-hydroxy-1-phenylmethyl)-2-methyl-γ-butyrolactone.

6. A smoking composition comprising an admixture of (1) combustible filler selected from natural tobacco, reconstituted tobacco and tobacco substitutes, and (2) between about 0.0001–5 weight percent, based on the total weight of filler, of a flavorant-release additive corresponding to the

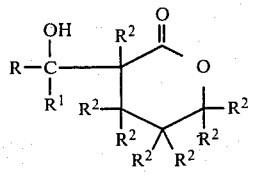

where R is an aromatic substituent containing between about 4–10 carbon atoms; and $R^1$ and $R^2$ are substituents selected from hydrogen and aliphatic, aromatic and alicyclic radicals containing between about 1–10 carbon atoms.

7. A smoking composition in accordance with claim 6 wherein in the flavorant-release additive formula R is a phenyl or substituted phenyl radical, and $R^1$ and $R^2$ are hydrogen or an alkyl radical containing between about 1–4 carbon atoms.

8. A smoking composition in accordance with claim 6 wherein the flavorant-release additive is 2-(1-hydroxy-1-phenylmethyl)-δ-valerolactone.

9. A smoking composition in accordance with claim 6 wherein the flavorant-release additive is 2-(1-hydroxy-1-methyl-1-phenylmethyl)-δ-valerolactone.

10. A smoking composition in accordance with claim 6 wherein the flavorant-release additive is 2-(1-hydroxy-1-phenylmethyl)-2-methyl-δ-valerolactone.

11. A method of preparing a smoking composition which is adapted to impart flavor and aroma to mainstream and sidestream smoke under smoking conditions, which method comprises incorporating into natural tobacco, reconstituted tobacco or tobacco substitute between about 0.0001–5 weight percent, based on composition weight, of a flavorant-release additive corresponding to the formula:

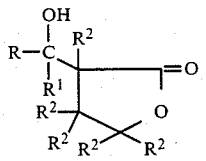

where R is an aromatic substituent containing between about 4–10 carbon atoms; and $R^1$ and $R^2$ are substituents selected from hydrogen and aliphatic aromatic and alicyclic radicals containing between about 1–10 carbon atoms.

12. A method of preparing a smoking composition which is adapted to impart flavor and aroma to the mainstream and sidestream smoke under smoking conditions, which method comprises incorporating into natural tobacco, reconstituted tobacco or tobacco substitute between about 0.001–5 weight percent, based on composition weight, of a flavorant-release additive corresponding to the
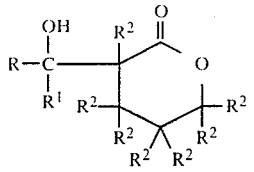
where R is an aromatic substituent containing between about 4–10 carbon atoms; and $R^1$ and $R^2$ are substituents selected from hydrogen and aliphatic, aromatic and alicyclic radicals containing between about 1–10 carbon atoms.
* * * * *